US005576710A

United States Patent [19]

Broderick et al.

[11] Patent Number: 5,576,710

[45] **Date of Patent: * Nov. 19, 1996**

[54] ELECTROMAGNETIC ENERGY ABSORBER

[75] Inventors: John F. Broderick, Andover; Noel J. Tessier, North Attleboro; Michael S. Heafey, Billerica; Michael T. Kocsik, Ashland, all of Mass.

[73] Assignee: Chomerics, Inc., Woburn, Mass.

[ * ] Notice: The term of this patent shall not extend beyond the expiration date of Pat. No. 5,325,094.

[21] Appl. No.: 261,386

[22] Filed: Jun. 16, 1994

(Under 37 CFR 1.47)

Related U.S. Application Data

[63] Continuation-in-part of Ser. No. 883,545, May 15, 1992, Pat. No. 5,325,096, which is a continuation-in-part of Ser. No. 489,924, Feb. 16, 1990, Pat. No. 5,214,432, which is a continuation-in-part of Ser. No. 177,518, Apr. 11, 1988, Pat. No. 5,223,849, which is a continuation-in-part of Ser. No. 10,448, Feb. 3, 1987, abandoned, which is a continuation-in-part of Ser. No. 934,716, Nov. 25, 1986, abandoned.

[51] Int. Cl.[6] ..... H01Q 17/00

[52] U.S. Cl. ..... 342/1

[58] Field of Search ..... 342/1, 2, 3, 4

[56] References Cited

U.S. PATENT DOCUMENTS

| | | |
|---|---|---|
| Re. 25,564 | 4/1964 | Alford et al. . |
| 2,464,006 | 3/1949 | Tiley . |
| 2,527,918 | 10/1950 | Collard . |
| 2,599,944 | 6/1952 | Salisbury . |
| 2,674,644 | 4/1954 | Goodlee . |
| 2,771,602 | 11/1956 | Kohnhold . |
| 2,797,201 | 6/1957 | Veatch et al. . |
| 2,841,786 | 7/1958 | Dicke . |
| 2,898,561 | 8/1959 | Hayes . |
| 2,923,934 | 2/1960 | Halpern . |
| 2,951,247 | 8/1960 | Halpern et al. . |

(List continued on next page.)

FOREIGN PATENT DOCUMENTS

| | | |
|---|---|---|
| 2114422 | 10/1957 | Australia . |
| 1279131 | 10/1968 | Germany . |
| 814310 | of 0000 | United Kingdom . |
| 665747 | of 0000 | United Kingdom . |

OTHER PUBLICATIONS

Chatterjee, S. K. et al., "A Two-Dimentional Array Absorber For Microwaves", Sep. 11, 1968, pp. 103–119.

"Design of Circuit Analog Absorber" (U), Jun. 1970, AD-509-756 (Conf.).

"Development of Circuit Analog Radar Absorber Materials", 6th Quarterly Engineering Report (U), Mar. 1966, AD-371-707 (Conf.).

"Development of Circuit Analog Radar Absorber Materials", 3rd Quarterly Engineering Report (U), May 1965, AD-363-957 (Conf.).

"1980 Radar Camouflage Symposium" (U) Final Report, Mar. 1981, Revised Edition, ADC-029-168L (Secret).

(List continued on next page.)

*Primary Examiner*—Ian J. Lobo

*Attorney, Agent, or Firm*—Bookstein & Kudirka, P.C.

[57] ABSTRACT

An electromagnetic energy absorber provides a base having an electrically conductive ground plane positioned thereover. At least one dielectric and one impedance layer are positioned over the ground plane or surface on a side thereof opposite the base. An external most dielectric skin seals the structure. Additional alternating dielectric and impedance layers can be positioned over the first dielectric and impedance layers. The impedance layer, can be formed from a resistive sheet formed into a broken pattern that can comprise a series of geometric shapes spaced from each other. The broken pattern is sized to vary the specific impedance of the sheet. The resistive sheet can be combined with a series of composite dielectric layers to form an integral composite structure. Three resistive sheet layers can be provided with predetermined spacings from the ground surface and predetermined impedance to effect broadband absorption characteristics.

31 Claims, 6 Drawing Sheets

U.S. PATENT DOCUMENTS

| | | |
|---|---|---|
| 2,992,425 | 7/1961 | Pratt . |
| 2,992,426 | 7/1961 | Borcherdt . |
| 2,996,709 | 8/1961 | Pratt . |
| 2,996,710 | 8/1961 | Pratt . |
| 3,061,495 | 10/1962 | Alford . |
| 3,152,328 | 10/1964 | McMillon . |
| 3,185,986 | 5/1965 | McCaughna et al. . |
| 3,230,184 | 1/1966 | Alford . |
| 3,247,158 | 4/1966 | Alford . |
| 3,276,895 | 10/1966 | Alford . |
| 3,295,131 | 12/1966 | Hollingsworth . |
| 3,315,259 | 4/1967 | Wesch . |
| 3,315,261 | 4/1967 | Wesch . |
| 3,316,139 | 4/1967 | Alford et al. . |
| 3,381,293 | 4/1968 | Tarpley, Jr. . |
| 3,427,619 | 2/1969 | Wesch et al. . |
| 3,443,020 | 5/1969 | Loshigian . |
| 3,540,047 | 11/1970 | Walser et al. . |
| 3,542,939 | 11/1970 | Mintz . |
| 3,622,437 | 11/1971 | Horaica . |
| 3,623,099 | 11/1971 | Suetake . |
| 3,680,037 | 7/1972 | Nellis et al. . |
| 3,705,432 | 12/1972 | Watkins, Jr. . |
| 3,707,414 | 12/1972 | Wismer . |
| 3,708,871 | 1/1973 | Mintz . |
| 3,729,756 | 5/1973 | Cook et al. . |
| 3,733,606 | 5/1973 | Johansson . |
| 3,737,903 | 6/1973 | Suetake et al. . |
| 3,752,899 | 8/1973 | Bakker . |
| 3,754,255 | 8/1973 | Suetake et al. . |
| 3,789,404 | 1/1974 | Munk . |
| 3,835,208 | 9/1974 | Koutitonsky . |
| 3,849,350 | 11/1974 | Matsko . |
| 3,887,920 | 6/1975 | Wright et al. ..... 342/1 |
| 3,996,654 | 12/1976 | Johnson . |
| 4,021,589 | 5/1977 | Copley . |
| 4,023,174 | 5/1977 | Wright . |
| 4,037,009 | 7/1977 | Severinsen . |
| 4,038,660 | 7/1977 | Connolly et al. . |
| 4,040,165 | 8/1977 | Miessler et al. . |
| 4,047,174 | 9/1977 | Wohlers . |
| 4,075,967 | 2/1978 | Silvey . |
| 4,084,161 | 4/1978 | Manning et al. . |
| 4,118,704 | 10/1978 | Ishino et al. . |
| 4,156,033 | 5/1979 | Bienz . |
| 4,173,018 | 10/1979 | Dawson et al. . |
| 4,229,491 | 10/1980 | Dislich et al. . |
| 4,301,456 | 11/1981 | Lovick, Jr. . |
| 4,439,768 | 3/1984 | Ebneth et al. . |
| 4,448,106 | 5/1984 | Knapp . |
| 4,474,129 | 10/1984 | Watkins et al. . |
| 4,493,874 | 1/1985 | Kubo et al. . |
| 4,520,562 | 6/1985 | Sado et al. . |
| 4,538,151 | 8/1985 | Hatakeyama et al. . |
| 4,539,433 | 9/1985 | Ishino et al. . |
| 4,557,965 | 12/1985 | Karlsson . |
| 4,560,445 | 12/1985 | Hoover et al. . |
| 4,581,284 | 4/1986 | Eggert et al. . |
| 4,605,934 | 8/1986 | Andrews . |
| 4,606,848 | 8/1986 | Bond . |
| 4,606,966 | 8/1986 | Karlsson . |
| 4,614,946 | 9/1986 | Kaminetzky . |
| 4,675,690 | 6/1987 | Hoffman . |
| 4,684,952 | 8/1987 | Munson et al. . |
| 4,716,417 | 12/1987 | Grumet . |
| 4,742,354 | 5/1988 | Wen et al. . |
| 4,748,449 | 5/1988 | Landers, Jr. et al. . |
| 4,791,419 | 12/1988 | Eubanks . |
| 4,888,590 | 12/1989 | Chase . |
| 5,325,094 | 6/1994 | Broderick et al. . |

OTHER PUBLICATIONS

"Proceedings of the 1975 Radar Camouflage Symposium" (U), Dec. 1975, ADC–006–173 (Secret).

"The Spiral Antenna", R. Bawer et al., Aero GeoAstro Corporation, Alexandria, VA; Report Under Air Force Contract, AF33 (600)–37829.

ELECTROMAGNETIC ENERGY ABSORBER

RELATED APPLICATION

This application is a continuation-in-part of U.S. Ser. No. 07/883,545, filed May 15, 1992, now U.S. Pat. No. 5,325,094 which is a continuation-in-part of U.S. Ser. No. 489,924 filed Feb. 16, 1990, now U.S. Pat. No. 5,214,432 on May 25, 1993, which is a continuation-in-part of U.S. patent application Ser. No. 07/177,518, filed on Apr. 11, 1998, which issued as U.S. Pat. No. 5,223,849 on Jun. 29, 1993, which is a continuation-in-part of U.S. patent application Ser. No. 07/010,448 filed on Feb. 23, 1987, now abandoned, which is, in turn, a continuation-in-part of U.S. patent application Ser. No. 06/934,716, filed on Nov. 25, 1986, now abandoned.

FIELD OF THE INVENTION

The present invention relates generally to an electromagnetic energy absorber and more particularly to a layered material for forming structures that absorb microwave radiation.

BACKGROUND OF THE INVENTION

It is often desirable in a variety of applications to provide surfaces with the capability of absorbing radar and similar electromagnetic waves. In so absorbing these waves, a substantially lower magnitude of energy is reflected back to the source of the incident waves.

A variety of prior art absorbers are constructed as separate units that are subsequently positioned over a structure. Such absorbers are known as parasitic absorbers. These absorbers may comprise several layers of resistive material (so called Jauman Absorbers). A typical type of resistive absorber comprises a parasitic carbonyl iron filled rubber panel that is fitted over a given structure. Absorbers can also take the form of a plurality of layers of conductive dipoles sandwiched between dielectric layers. Such dipole absorbers are further described in co-pending U.S. patent applications Ser. Nos. 07/177,518 and 07/489,924, now U.S. Pat. Nos. 5,223,849 and 5,214,432, respectively.

In producing layered absorbers it has also been necessary to utilize a material having a sufficiently low dielectric constant to obtain sufficiently wide absorption bandwidths. Often, however, such materials do not exhibit sufficient structural strength.

In view of the above-described disadvantages of the prior art, this invention has as one object to provide a material for constructing a layered electromagnetic energy absorber with sufficient strength to serve as an integral part of an overall structure.

It is a further object of this invention to provide an electromagnetic energy absorber that may be constructed with relative ease in a variety of shapes and configurations.

It is a further object of this invention to provide an electromagnetic energy absorber that substantially reduces or eliminates undesirable backscatter effects that may be present in certain absorbing structures.

It is yet another object of this invention to provide a broadband electromagnetic energy absorber that provides absorption over a wide range of operating frequencies.

SUMMARY OF THE INVENTION

An electromagnetic energy absorber according to one embodiment of this invention provides a structural base comprising an electrically-conductive member referred to herein as a ground plane or surface. The electrically-conductive ground plane or surface can also be part of another structural member. The ground plane can be formed of copper or a suitable conductive material. Over the base and ground plane is positioned at least a first dielectric layer and over this dielectric layer is positioned a first impedance layer. The first impedance layer comprises a series of dipoles arranged in a semirandom or comparable pattern that can be constructed from conductive ink. An outermost dielectric skin of predetermined thickness generally covers at least the first two layers. However, additional alternating dielectric layers and conductive dipole layers can be arranged between the first pair of dielectric and conducting layers and the outermost skin. The dielectric material can comprise an epoxy resin-based, microballoon-filled, syntactic foam. Such a material has a relatively low dielectric constant and, thus, provides good broadband absorption characteristics to the structure. The layers can be joined together by adhesives or other suitable processes.

According to another embodiment of this invention, an electromagnetic energy absorber can be constructed by providing layers of dielectric material over a conductive ground plane surface. One possible realization of these dielectric layers could be fiberglass reinforced epoxy composites. Between the layers of dielectric material are positioned thin layers of resistive film, generally having complex impedance characteristics (that is, nonzero reactances). These layers can be constructed by cutting or otherwise removing geometric sections from an electrically-resistive film in either periodic or semirandom fashion.

These layers can also be constructed by cutting or otherwise removing sections of the film thereby leaving geometric sections of the film to form a broken pattern in either periodic or semirandom fashion. Such layers are referred to as resistive circuit analog layers. Impedance layers constructed from electrically resistive sheets of carbon black filled plastic, of which polyimide plastic is one example, in combination with fiberglass reinforced epoxy composites, provide good absorption performance.

An absorber, according to this embodiment can be constructed by providing a plurality of layers of bidirectional and unidirectional fiberglass fabrics, laid one atop another with an electrically conductive layer and resistive circuit analog layers positioned therebetween. The layered arrangement of fiber can then be joined by injecting an epoxy or other suitable resin into the arrangement. Upon curing, which can include application of heat, an integral structure is formed. The base or ground plane, which can be the structural frame of a particular object or a separate conductive surface, can be formed simultaneously with the absorber by providing a plurality of fiberglass layers on the side of the conductive layer opposite the resistive sheet layers.

According to another embodiment of this invention, a broadband electromagnetic energy absorber can be constructed as either a structural member or a parasitic absorber by providing three resistive layers having broken patterns defined therein between respective dielectric layers. The resistive layers are constructed to have impedances that define predetermined multiples relative to the impedance of free space. The three layers are spaced from each by respective dielectric layers to obtain a maximum range of absorption over a predetermined frequency spectrum.

According to a preferred embodiment, the dielectric material can comprise polyethylene foam. A variety of other dielectric materials are contemplated. Similarly, the resistive material can comprise a lossy material-filled polyimide sheet. However, other resistive sheet materials are specifically contemplated.

BRIEF DESCRIPTION OF THE DRAWINGS

The foregoing and other objects and advantages of the invention will become more clear with reference to the following detailed description of the preferred embodiments as illustrated by the drawings in which.

DETAILED DESCRIPTION OF THE PREFERRED EMBODIMENT

Figure 1:
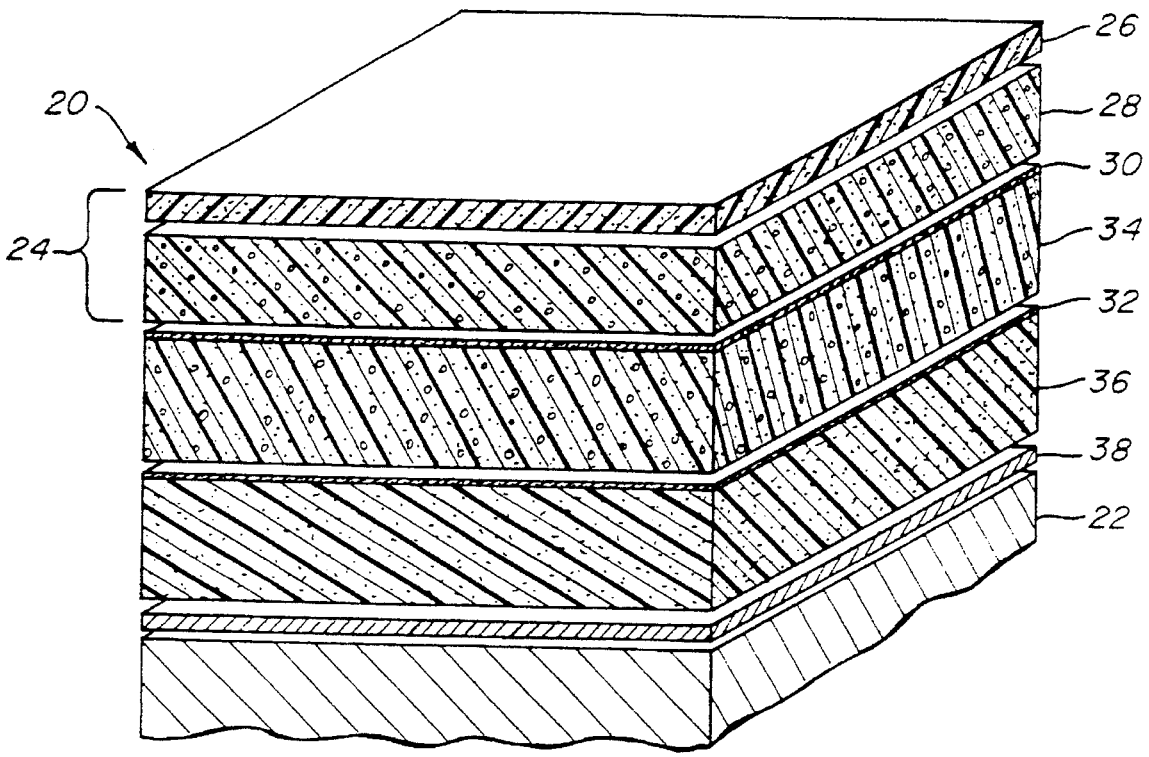
FIG. 1 is a perspective view of an electromagnetic energy absorbing structure according to one embodiment of the invention.

FIG. 1 illustrates a layered circuit analog, typically non-parasitic, electromagnetic energy absorbing structure, particularly adapted to radar frequencies, typically in the 2–18 GHz band, but also applicable to a range between approximately 500 Mhz to 94GHz. The structure 20 comprises a base layer 22 that can be of any desired thickness. This base layer 22 generally comprises the primary structural frame or shell of the object to be shielded by the more externally disposed absorber surface. The external most layer 24 of the structure 20 comprises a dielectric material. In this embodiment, the layer includes an outermost or external most skin 26 (closest to the incident electromagnetic wave) and inner dielectric layer 28. Internal (as taken in a direction toward the base layer 22) of the externally disposed layer 24 is positioned a pair of circuit analog conducting layers 30 and 32, respectively. The circuit analog layers 30 and 32 are divided by another dielectric layer 34. Yet another dielectric layer 36 is positioned internally of the layer 32. This layer 36 rests upon an electrically conductive shield or ground plane 38 of the absorber structure 20.

While the base 22 is separate from the conductive ground plane in this example, the base can provide the ground plane surface (e.g. the surface of a structural member) when it is constructed of a suitable conductive material such as steel, aluminum or copper. Such a surface can be utilized where the outer surface of the base structural member is regular enough to allow the overlying dielectric and circuit analog layers to be positioned over the base surface without substantial variation in the thickness of the layers. For example, a riveted base surface can possibly prove too irregular for a reliable layered absorber structure to be built thereover without an underlying separate ground plane shield. Therefore, whether or not the underlying conductive base can also serve as the ground plane largely depends upon its surface contour as well as other structural and application considerations, such as, removability and replaceability of the absorber structure.

Dipole-type absorbers (Circuit Analog absorbers) are generally designed with three controlling factors in mind. In particular:

(1) The impedance of the circuit analog layer or layers (i.e., the characteristic reflection and transmission coefficients of the layer) controls the depth (degree of absorption) of the absorptive null point for a particular frequency value. In other words, it is important to accurately match the impedance of the circuit analog layer to a particular frequency for which maximum absorption is desired.

(2) The position of the circuit analog layer relative to an underlying conductive ground plane (in this example a copper mesh or plate) tends to control the frequency of a particular null. The more circuit analog layers utilized, the more nulls that are present.

(3) The dielectric constant of the various intermediate layers between circuit analog layers and, generally, on the external surface of the absorber, controls the bandwidth of a given null. In general, the lower the dielectric constant of the intermediate layers, the wider the bandwidth.

Figure 8:
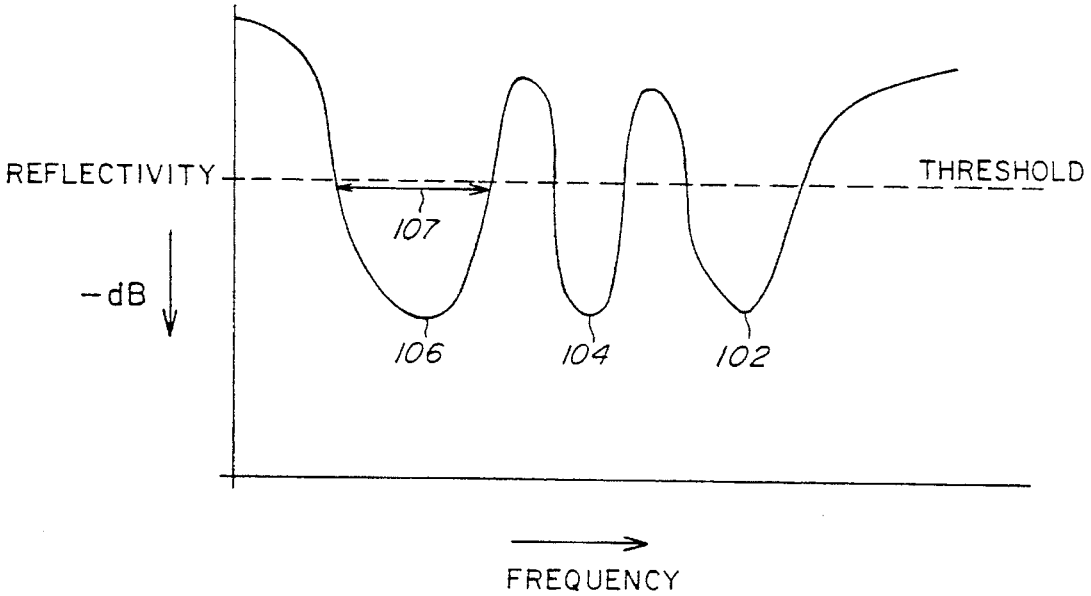
FIG. 8 is a graph illustrating generally a characteristic absorption curve including three absorptive nulls according to this invention.

For an illustration of an absorption spectrum for a typical two impedance layer absorber structure having three absorptive nulls 102, 104 and 106, see FIG. 8.

As noted above, the necessary thicknesses of the various dielectric layers are determined by the desired frequencies of maximum energy absorption, known as nulls. In one example of this embodiment, the external skin 26 comprises a fiberglass reinforced epoxy composite layer having a thickness of approximately 0.035 inch. The external most dielectric layer 28 has a thickness of approximately 0.10 inch while the two more internal dielectric layers 34 and 36 have a thickness of approximately 0.15 inch each. The underlying ground plane 38, which comprises pure copper in this example, has a thickness of 0.015 inch. Such a thickness should provide good reflection characteristics to incident waves.

Each of the circuit analog layers 30 and 32 are constructed so as to be easily applicable to the surface. Hence, these layers are each applied directly to the underlying dielectric layers, 34 and 36 respectively, using a conductive ink. A variety of conventional conductive inks, including, for example, nickel and copper filled inks, can be utilized according to this invention. The exact thickness of each ink layer is relatively small in comparison with the intervening dielectric layers and, therefore, does not significantly alter the spacing of the structure 20.

In order to provide a desirably low dielectric constant in the two external most dielectric layers 28 and 34, while still providing effective structural strength, the structure according to this embodiment utilizes a syntactic foam. Such a foam comprises, typically, an epoxy resin with a microballoon filler that increases the encapsulated air content of the epoxy. Hence, a relatively low dielectric constant can be achieved while providing relatively good structural strength. A dielectric syntactic by Emerson and Cuming, Inc. having a dielectric constant of approximately 1.5 can be utilized according to this invention.

It should be noted that, since the conductive ink of the circuit analog layer is laid directly upon the foam, it is desirable that the ink remain compatible with the foam. Otherwise, its electrical performance may be degraded. A nickel based conductive ink having an epoxy binder is utilized in this embodiment. Other inks and binders such as urethane, acrylic and various liquid polymers are also contemplated according to this invention, however.

It should also be noted that the layers of the structure 20 according to this embodiment are bonded to each other by means of suitable adhesive such as epoxy, urethane, silicone or other adhesives that are compatible with the ink and the foam.

The layers of the structure 20 of FIG. 1 can possibly be formed from material having a dielectric constant higher than that of syntactic foam in this example. In particular, the internal most dielectric layer 36 is constructed of a fiberglass reinforced epoxy material or a similar composite. In addition, as noted above, the external skin 26 comprises a fiberglass reinforced epoxy material. The fiberglass reinforced epoxy composite according to this embodiment has a dielectric constant of approximately 4.7. Due to the thinness of the external skin (approximately 0.03 inch) the external skin exhibits an effective impedance characteristic. As such, this layer controls the location of the electromagnetic energy absorption null in one of the predetermined absorption frequency ranges.

Figure 2:
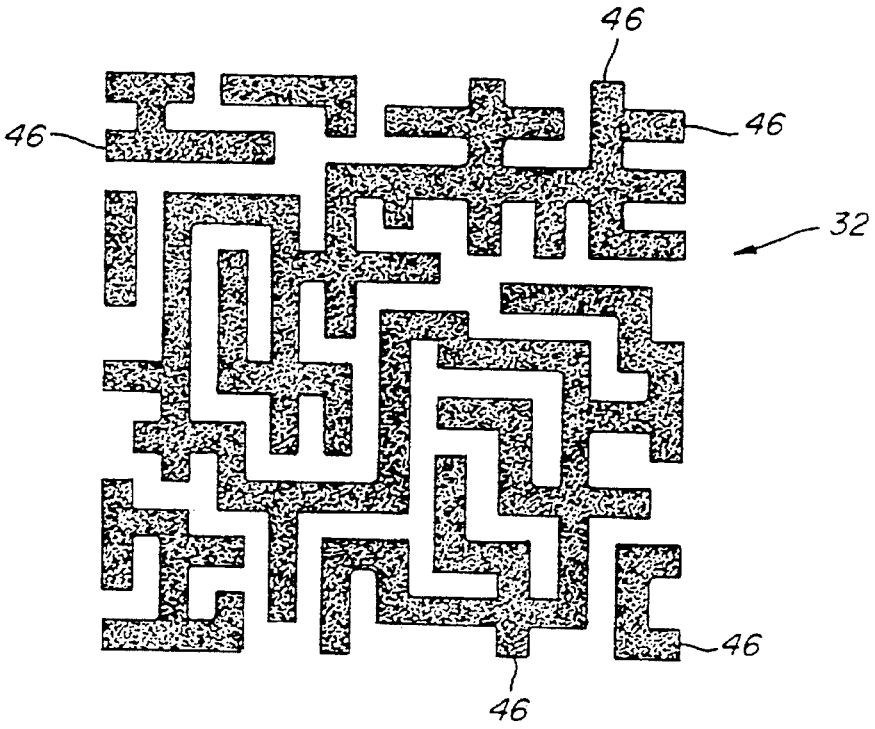
FIG. 2 is a plan view of a circuit analog substrate layer for use in the electromagnetic energy absorbing structure of FIG. 1.
Figure 3:
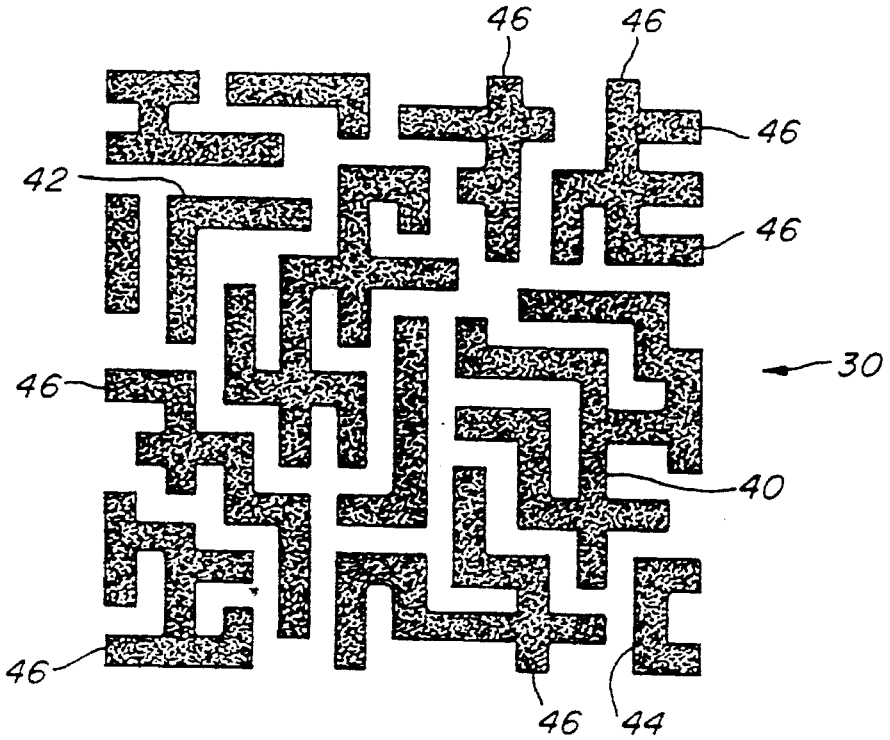
FIG. 3 is a plan view of a circuit analog superstrate layer for use in the electromagnetic energy absorbing structure of FIG. 1.

The circuit analog layers 30 and 32 carry a predetermined pattern defining a plurality of dipoles of predetermined width, length, and angular orientation. A variety of dipole patterns are contemplated according to this invention. Many possible patterns are illustrated in U.S. Pat. No. 5,214,432. However, a particular pattern having high randomness and easy repeatability is illustrated for the circuit analog layer 32 in FIG. 2 and for the circuit analog layer 30 in FIG. 3. Reference is now made to FIGS. 2 and 3 collectively and also individually where appropriate.

FIGS. 2 and 3 show, respectively, circuit analog patterns for the layer 32 closest to the ground plane 38 and the layer 30 further from the ground plane 38. These patterns are generally applied to underlying dielectric layers of the structure by screen printing a conductive ink. The darkened pathways of each pattern indicate ink locations. It should be noted that the pattern of FIG. 3 is not as dense as that of FIG. 2. In general, each pattern is formed to absorb energy in a discrete frequency range. A given impedance for the circuit analog layer dictates the absorption frequency range. Impedance of the layer pattern is, itself, governed by four parameters including (1) the pattern dipole element line width, (2) length of the dipole elements, (3) orientation of the dipole elements upon the surface, and (4) the conductivity of the ink from which the dipole elements are constructed. In general, the denser the pattern, all other factors being equal, the lower the impedance and the lower the absorption frequency. By experimentally varying each of these parameters, a different absorption frequency range for each layer can be obtained. Since the range of each layer is contemplated as being different, the pattern element length and width, as well as the density of elements for each layer is varied. Generally, conductivity of the ink remains the same for the pattern of each layer.

Orientation of the elements is generally similar for each pattern. The orientation depicted reveals a substantially exponential distribution of element lengths. For any given pattern, such as the pattern of FIG. 3, there will exist two long dipoles 40, four medium length dipoles 42, and sixteen short dipoles 44. These dipoles have lengths that are, typically, at least a tenth of a wavelength for the frequency of a desired absorptive null.

The patterns of FIGS. 2 and 3 comprise a self-contained repeatable pattern that may be easily screened over the entire surface of the structure. Thus, the pattern is easily adaptable to machine controlled screen printing processes. When properly applied, each width-defining end (such as ends 46 in FIG. 3) mates with a width-defining end of an adjacent identical pattern. Thus the dipoles of each square pattern join with dipoles of adjacent squares. An unbroken chain of dipoles can, therefore, be disposed across the entire surface of the structure.

Figure 4:
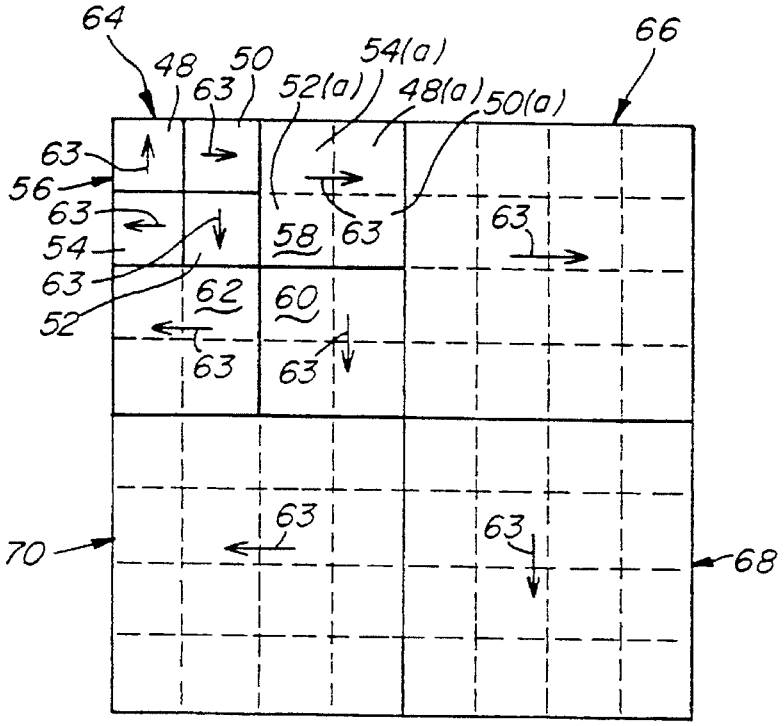
FIG. 4 is a schematic plan view of a semirandom rotation pattern for use with the circuit analog patterns of FIGS. 2 and 3.

It is further desirable to construct a dipole pattern that is as random as possible upon the surface. Thus, the pattern of FIGS. 2 and 3 is designed so that it can be rotated through four consecutive 90° turns and still allow mating between width-defining dipole ends (46). Hence, a pattern as shown schematically in FIG. 4 can be applied to a surface. As stated, the pattern is made up of a plurality of adjacent squares as shown in FIGS. 2 and 3. Each of these individual squares can be, for example, 1 inch×1 inch. The overall design of each individual square in the pattern is the same. However, FIG. 4 illustrates how a semirandom array of similar squares can be arranged by alternating the orientation of the pattern. As noted above, the pattern of FIGS. 2 and 3 is designed to mesh with identical adjacent patterns in such a manner that any side of the pattern can mesh to any other side of the same pattern to form an unbroken chain of dipoles.

FIG. 4 illustrates a plurality of boxes, each representative of a given dipole pattern. Each of the boxes is oriented according to its respective arrow 63. These arrows are representative of an arbitrary orientation for the pattern. For example, pattern box 48 includes an arrow 63 pointing straight upwardly. Such an arrow indicates a first orientation. Box 50, adjacent to box 48, shows an arrow 63 rotated 90° clockwise relative to the arrow 63 of box 48. Thus, the pattern in box 50 has rotated 90° relative to the box 48 pattern. Similarly, the arrow 63 of box 52 indicates that its pattern is rotated clockwise 180° relative to the pattern of box 48. Finally, box 54 includes a pattern rotated 270° relative to box 48.

It is desirable to dispose the dipole element pattern in a random or semirandom array across a given surface.

Semirandomness of the pattern is achieved according to this embodiment by rotating progressively larger groupings of pattern boxes (squares) by 90° intervals around a preceding grouping of boxes. In other words, box 58 comprises a set of four boxes. If one assumes that the set of 4 boxes 48, 50, 52 and 54, as a group, would comprise a first orientation (depicted by an upward arrow that is not shown), then box 58 would be rotated clockwise as a group by 90°. The individual pattern boxes 48(*a*), 50(*a*), 52(*a*) and 54(*a*) correspond to boxes 48, 50, 52 and 54 but have been rotated, as a group, by 90°. Box 60, comprising the same individual pattern of boxes as found in box 56 and 58 has been rotated by 180°. Similarly, box 62 has been rotated by 270°.

The overall grouping 64 of four boxes 56, 58, 60 and 62 that each, themselves, include the pattern of boxes analogous to 48, 50, 55 and 54, are again repeated in adjacent sets of boxes 66, 68 and 70 that are each rotated as shown by the arrow 63. Hence, as larger and larger groups of boxes are built into the pattern, they continue to rotate around the central most box 48. The substituent groups of boxes within each of the larger outwardly disposed boxes simply repeats rotational patterns of the more inwardly disposed sets of boxes.

Thus, the pattern of FIG. 4, makes possible the construction of a "semirandom" array of circuit analog dipoles from a single repeatable circuit analog pattern such as that shown in FIGS. 2 and 3. This semirandom pattern is, as stated above, desirable since it makes possible relatively even absorption over an entire structure surface according to this invention.

Even when low dielectric materials are utilized, circuit analog absorbers still retain some disadvantages for certain applications. One disadvantage is the existence of electromagnetic backscatter which occurs at certain predetermined frequencies and viewing angles. Backscatter arises because electrically conductive dipoles reradiate incident electromagnetic energy in a roughly omni-directional pattern. The reradiated energy of an array of regularly spaced dipoles adds constructively at a particular angle relative to the array for any particular frequency. This is differentiated from a specular, forward-scattered energy reflection, and instead, can scatter significant amounts of energy back to the source of the incident wave.

The above-described embodiment provides a highly effective electromagnetic energy absorbing structure. However, if no back scatter is tolerable with such a structure, it could be desirable to provide an electromagnetic energy absorbing structure based upon multiple layers of shaped resistive material. Resistive materials do not exhibit measurable backscatter since electromagnetic energy exciting the structure is attenuated rather than reradiated. An individual thin unbroken sheet of resistive material provides a relatively frequency-independent impedance curve across a broad range of frequencies. As such, a remaining disadvantage of resistive sheet layers is that they are not adapted to follow a particular impedance versus frequency curve as circuit analogs are.

Therefore, a resistive sheet layer does not exhibit the desired broadband null point absorption characteristic. This lack of deep broadband null points limits the uses of resistive sheet layers in certain electromagnetic energy absorption applications.

In order to develop a characteristic impedance curve in a resistive sheet layer according to this invention one must form the resistive sheet into a circuit analog-type pattern. As used herein, a circuit analog pattern on a resistive sheet can be termed generally as "broken" since the sheet has a surface that is not continuous. The formation of a design comprising two layers of resistive sheets modified into circuit analog patterns according to this invention is shown in FIG. 5.

Figure 5:
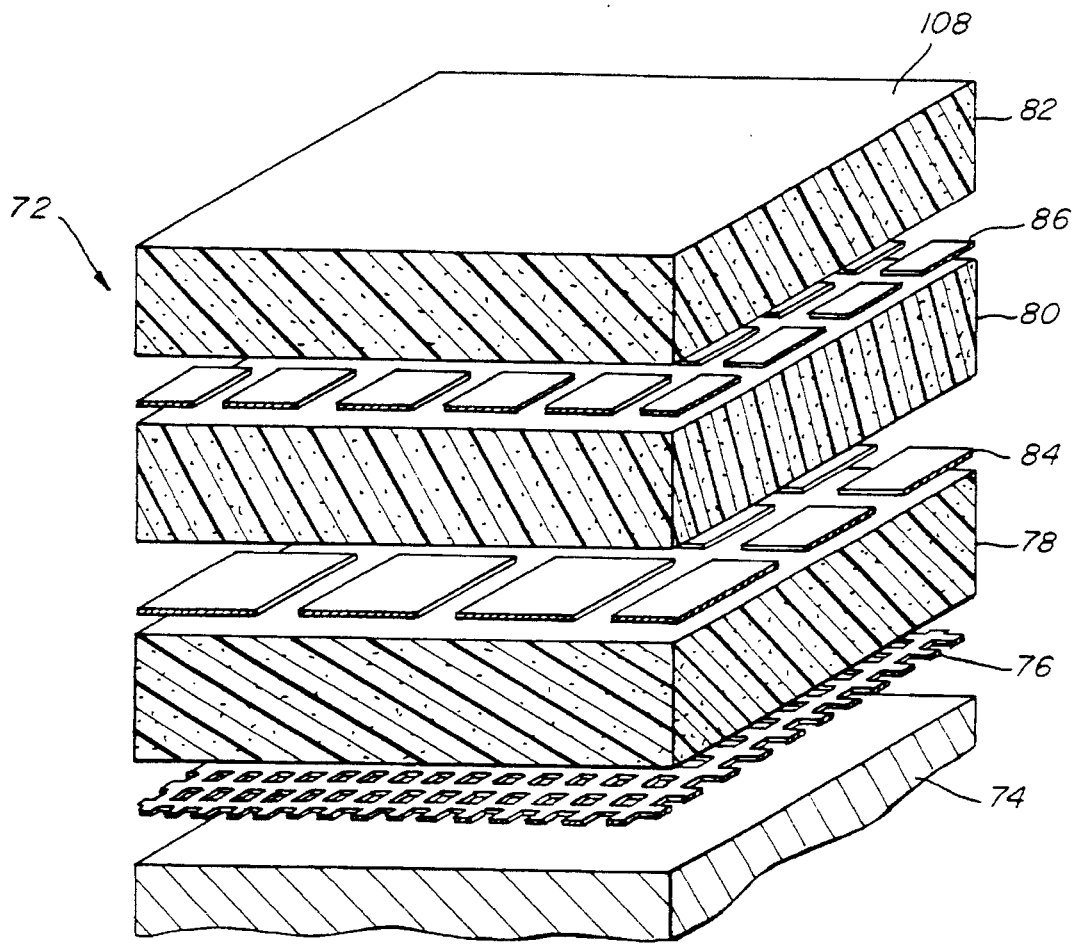
FIG. 5 is an alternative embodiment of an electromagnetic energy absorbing structure according to this invention.

FIG. 5 illustrates a multilayer resistive circuit analog electromagnetic energy absorbing structure 72 according to an alternative embodiment of this invention. The layered electromagnetic energy absorbing structure is formed over a base layer 74 that, like the layer 22 in FIG. 1, may comprise a primary structural frame or skin for the object to be shielded. The structure 72 includes a base 74 and an electrically conductive ground plane 76 comprising, in this embodiment, an expanded mesh screen of essentially pure copper.

It should be noted that an expanded mesh screen is constructed by perforating a sheet of copper with thin slots in one direction and then expanding the sheet in the direction perpendicular to the slots to obtain a desired diamond-shaped mesh size. An advantage of forming an electrically conductive ground plane sheet in this manner is that the sheet is substantially flat and fully interconnected, allowing for better reflection of incident waves. A woven screen can also be used. In general, a perforated screen of some type is desirable since it allows a liquid matrix, such as epoxy resin, to flow through the ground plane layer in this embodiment during the formation of the structure which is described further below.

External of the ground plane 76 are positioned alternating layers of fiberglass reinforced epoxy dielectric 78, 80 and 82 and intervening resistive circuit analog layers 84 and 86.

Figure 7:
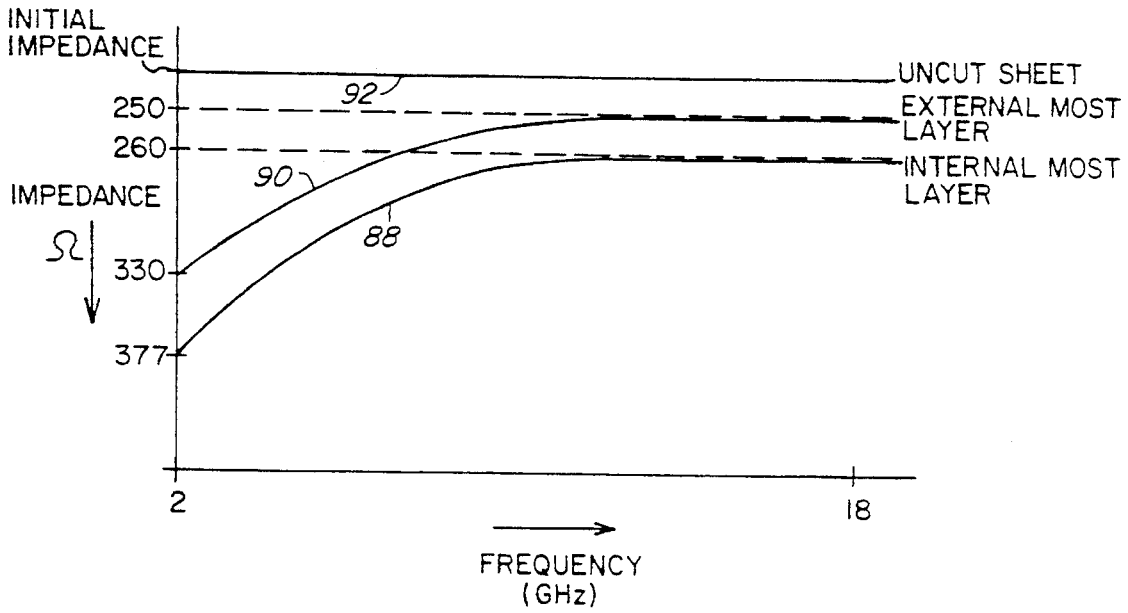
FIG. 7 is a graph of impedance versus frequency for each of an uncut resistive sheet and each of a pair of formed resistive sheets for each of two layers according to this invention.

Each of the circuit analog resistive layers 84 and 86 is formed in a separated square pattern according to this embodiment. By separating the sheet into discrete divided squares, a circuit analog-type impedance curve can be obtained. Particular impedance curves for each of the resistive layers 84 and 86 are shown in FIG. 7. A given impedance curve according to this embodiment depends upon the size of the squares, their relative spacing, and the ohmic value of the resistive material. The precise impedance characteristics for any given sheet construction muss be determined experimentally. Thus, the impedance curves representing the closer resistive layer performance 88 and the further resistive performance 90 are variable based upon the particular material and configuration utilized. The curves of FIG. 7 are typical for carbon black filled polyimide film material such as DuPont XC™ film. Note that the initial resistive value of the uncut film is frequency-independent across the frequency range of FIG. 7 as illustrated by the curve for the uncut sheet 92.

In the embodiment of FIG. 5, impedance characteristics such as those shown in FIG. 7 are obtained by sizing squares in a range between 0.5 inch and 1.5 inches. A spacing of between 0.05 inch and 0.10 inch between squares is also used. The exact spacing and size for each layer is typically determined experimentally to obtain a desired impedance characteristic. In general, the resistive layer 86 further from the ground plane 76 will carry smaller squares than the closer resistive layer 84. The spacing between squares in each layer can be similar, however. While other geometric shapes can be utilized for the resistive circuit analog layer sheets, a square is preferred for manufacturing ease. The reflection pattern of a square closely approximates a circle and, thus, 360° rotation will yield substantially equal reflection. Note also that the square could, itself, comprise a number of smaller broken subsections such as triangles. In general, however, the shape should carry a symmetrical configuration so that impedance is constant throughout a 360° rotation of the surface. Thus, use of a hexagon, on equilateral triangle or another regular polygonal shape is possible according to this invention. Similarly, a number of other symmetrical and nonsymmetrical geometric arrangements for resistive layers are contemplated according to this invention.

Thus, in a preferred embodiment, impedance layers comprise a series of square patches of particular dimensions separated by gaps of particular widths. Such patterns generate frequency dependent impedance characteristics.

The proper combination of alternating thin layers of specific impedance characteristics, in conjunction with dielectric layers of specific dielectric constants and thicknesses, backed by a reflective ground plane layer, can set up an effective input impedance close to that of free space at the front face of the structure which allows for low reflected energy levels (deep nulls) in frequency bands around desired center frequencies.

Figure 6:
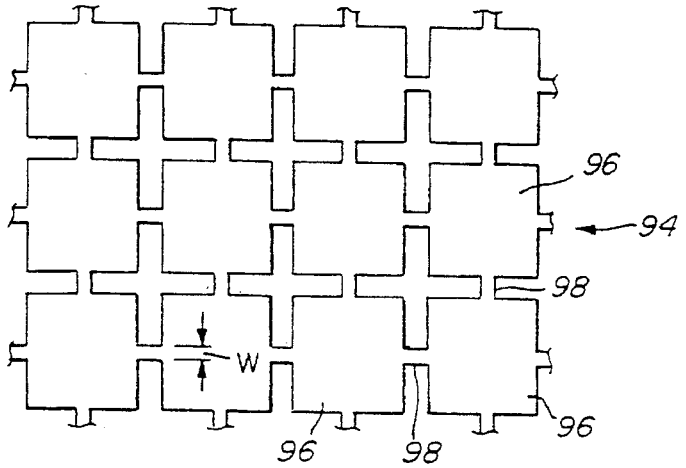
FIG. 6 is a plan view of a resistive circuit analog layer for use in the electromagnetic energy absorbing structure of FIG. 5.

The specific manufacturing of a radar absorbing structure according to this embodiment will be described further below. For ease of manufacture of the structure, it would be desirable to form the resistive layers 84 and 86 as single units. FIG. 6 shows one method of forming a cut square sheet 94 in which the squares 96 are still joined by narrow runners 98. Hence, the sheet may be laid upon the surface of the structure 72 as a discrete singular layer. The runners 98 guarantee that a predetermined spacing will be maintained between each of the squares 96 in the sheet 94. The structural strength added by the runners is particularly useful when the structure is formed using high pressure and high temperature forming techniques.

The runners 98 are maintained relatively narrow in this embodiment. A width W of 0.080 inch should suffice to provide structural strength to a sheet formed, for example, from polyimide. In practical terms, the runners 98 do not affect impedance characteristics of the layer and, in fact, may improve the overall performance of the layer by insuring an accurate spacing and orientation of squares 96 relative to one another.

Referring again to FIG. 5, the thickness of each of the dielectric layers 78, 80 and 82 must be controlled closely in order to obtain absorptive nulls at desired frequencies. As noted, a two impedance layer absorber structure will generate three characteristic absorptive nulls. These three nulls can be represented generally by the graph in FIG. 8 and occur at a highest frequency 102, a middle range frequency 104, and a lowest frequency 106. As noted above, if the frequency of the incident electromagnetic energy falls within the bandwidth 107 of a given null, the incident waves are absorbed sufficiently to prevent their measurable reflection. Absorption below a "threshold" amount indicated by the dotted line prevents such measurable reflection.

The thickness distance between the external surface 108 and the more external resistive layer 86 controls the frequency of the highest absorptive null 102. This distance is characterized by the electrical thickness of the external dielectric layer 82. Similarly, the distance between the more external resistive layer 86 and the more internal resistive layer 84 controls the frequency of the middle absorptive null 104. This distance is characterized by the electrical thickness of the middle dielectric layer 80. Finally, the lowest absorptive null 106 is controlled by the distance between the resistive layer 84 and the ground plane screen 76. This distance is characterized by the electrical thickness of the internal most dielectric layer 78. The thickness of the film of each resistive layer 84 and 86 is itself relatively insignificant and, thus, does not substantially influence the frequency location of each absorptive null. Particularly, a film such as DuPont XC™ polyimide film is typically on the order of 0.002 inch to 0.004 inch thickness.

As discussed above, each of the dielectric layers 78, 80 and 82 of FIG. 5 are constructed from fiberglass-reinforced epoxy. Fiberglass reinforced epoxy composite has an advantage over syntactic foam in that it is stronger and, thus, particularly suited for structures subjected to severe environmental conditions. Fiberglass reinforced epoxy is also more easily formed into shapes since it allows for injection of resin in a cavity mold to bind an otherwise easily formable reinforcing fabric, such as fiberglass, polyimide or polyethylene, so as to allow formation of a variety of complex shapes. Syntactic foam can sometimes prove more limited in its formation into complex shapes.

The resin can, in fact, be a variety of hardenable liquid matricies including epoxy and polyester according to this embodiment. The layers of the structure can be formed from a combination of materials including, for example, a layer of woven polyethylene and a layer of fiberglass, in which each material is chosen for its particular dielectric and/or other characteristics.

A typical disadvantage of fiberglass reinforced epoxy is that its dielectric constant is substantially higher than that of syntactic foam. Most standard fiberglass reinforced epoxy composites have a dielectric constant on the order of 4.7. As noted above, a higher dielectric constant narrows the bandwidth of each absorptive null. This means that a smaller frequency range will lie within the absorption threshold. Thus, it is desirable to lower the dielectric constant of the fiberglass reinforced epoxy composite as much as possible.

The dielectric constant of the fiberglass reinforced epoxy can be adjusted by changing the ratio of fiberglass to epoxy resin. It has been found that the dielectric constant of a material reinforced matrix composite structure, such as fiberglass reinforced epoxy composite, follows, generally, a volume fraction mixing rule such that:

$$D_{composite} = D_{material}^{V_{material}} \times D_{matrix}^{V_{matrix}}$$

In which D is the dielectric constant for the given constituent and V is the volume fraction for the given constituent.

Hence according to the above equation, by way of one example, by utilizing a 52% by volume fiberglass to 48% by volume epoxy resin ratio, using S-glass fiberglass with a dielectric constant of 5.1 and an epoxy resin with a dielectric constant of 3.2, it is possible to produce a composite having a dielectric constant of approximately 4.1. By constructing a composite having this dielectric constant, the resistive circuit analog absorber structure of this embodiment can obtain electromagnetic energy absorption performance similar to that of the syntactic foam conductive circuit analog embodiment described herein above.

The thickness of the fiberglass reinforced epoxy layers tend to increase from external most to internal most. In one embodiment, the external layer 82 has a thickness of 0.130 inch. The middle layer 80 has a thickness of 0.140 inch and the internal most layer 78 has a thickness of 0.150 inch. In this embodiment, as in the syntactic foam embodiment, the ground plane 76 can have a thickness of approximately 0.015 inch.

An absorbing structure 72 according to FIG. 5 is constructed by providing plies of fiberglass fabric to build up the dielectric layers. The glass fabric layers are laid one over the other until an appropriate thickness is obtained. In general, glass fabric layers having a thickness of 0.010 inch are used. Thus, to form a 0.150 inch thick layer of dielectric, fifteen layers of glass fabric are laid one atop the other. Each dielectric composite layer can be formed by combining a number of bidirectional layers (usually in the form of woven glass fabric) with various unidirectional layers (usually comprising yarns of glass all running in a single direction and joined by intermittent crossing woven threads of glass). The use of unidirectional glass fabric enables the structure to carry increased flexural and tensile strength along a certain direction. This can be desirable when a structure must have enhanced rigidity along one direction. The packing ratio of unidirectional and bidirectional glass fabric also determines the glass volume fraction for the composite which, as stated above, affect the overall dielectric constant of the composite.

Layers of bidirectional and unidirectional glass fabric are plied up to a desired composite layer thickness. Between each built-up composite layer of fabric is positioned a sheet of resistive circuit analog material. The sheet, as noted above, is preformed into joined squares or similar geometric patterns.

Figure 9:
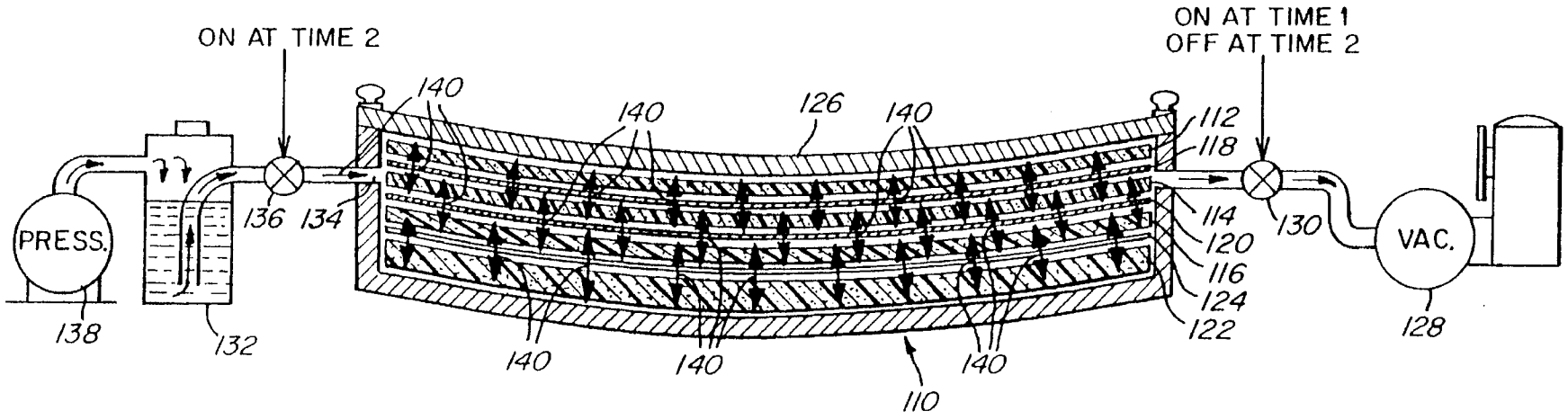
FIG. 9 is a schematic diagram illustrating a process for forming electromagnetic energy absorbing structures according to this invention.

Once the entire layered structure is assembled in a cavity mold, the structure is subjected to pressurized injection of epoxy resin. This process is illustrated in FIG. 9.

A cavity mold 110 having an internal shape that conforms to a desired structural shape is provided with alternating layers of fiberglass and resistive circuit analog patterned sheet. In this embodiment, the fiberglass dielectric layers 112, 114 and 116 sandwich a pair of resistive sheet layers 118 and 120. In this example, the base 122 of the structure is also constructed of fiberglass and, thus, a ground plane screen 124 is provided between the base 122 and the internal most dielectric layer 116.

As noted above, the spacing between the dielectric layers 112, 114 and 116, the ground plane and the resistive layers should be closely controlled. Thus, the fiberglass (in this example) material layers should be spread out across the mold evenly so as to avoid bulges and buckles. The mold in this example has a curve. The layers bend to conform to this curve. The exact thickness and contour of the base 122 can vary as long as the layers external of the ground plane 124 have a thickness that remains constant relative to the ground plane surface. In other words, at any point along the absorber surface, the tops and bottoms of the layers should be equal in depth from the ground plane.

In this example there is space shown between layers for illustration purposes. However, in practice the layers should be maintained in close proximity to each other to insure accurate maintenance of the desired layer thickness.

The mold 110 is sealed by a cover 126 so that it can be made air tight. Upon sealing, after initial layup of the layers, the mold 110 is generally evacuated (at a first TIME 1) by a vacuum source 128. The source should include a valve 130 that allows the mold 110 to be isolated from the vacuum source 128 to allow maintenance of a continuous vacuum within the mold after TIME 1.

Once the mold 110 is evacuated, epoxy resin or a similar hardenable liquid matrix from a resin source 132 is introduced at TIME 2 to the mold 110 via an inlet 134 that includes a valve 136. A number of inlets to the mold 110 can be employed depending upon the size and complexity of the structure. The matrix flows into the evacuated mold 110 under pressure from a pressure source 138.

The matrix has sufficient flow characteristics to pass through the porous material (fiberglass cloth, for example) and ground plane screen as illustrated by the flow arrows 140. Thus, all parts of the structure become permeated by the matrix. The matrix is then allowed to harden to generate the final desired rigid structure.

The resin matrix epoxy utilized according to this particular embodiment requires thermal curing to obtain a final hardness. Curing occurs, for example, at approximately 160°–350° F. Polyimide is particularly suitable in providing a resistive circuit analog sheet since it can withstand temperatures of up to approximately 500° F. Thus, the curing temperature will not affect or degrade its performance. Polyimide is compatible for bonding to epoxy resin and, thus, becomes integrally and firmly secured to the overall structure. The initial sheet resistivity is, similarly, not degraded by epoxy resin.

The number of nulls generated by a particular absorber can be increased by increasing the number of layers of resistive or conductive material utilized between the outer or skin layer and the ground plane. It is often desirable to provide an absorber or an absorber structure having a broadband absorption characteristics over a given electromagnetic energy frequency range. By properly sizing and locating a multiplicity of absorber layers it is possible to generate an absorber or absorber structure that provides substantially continuous absorption characteristics over a given range.

Figure 10:
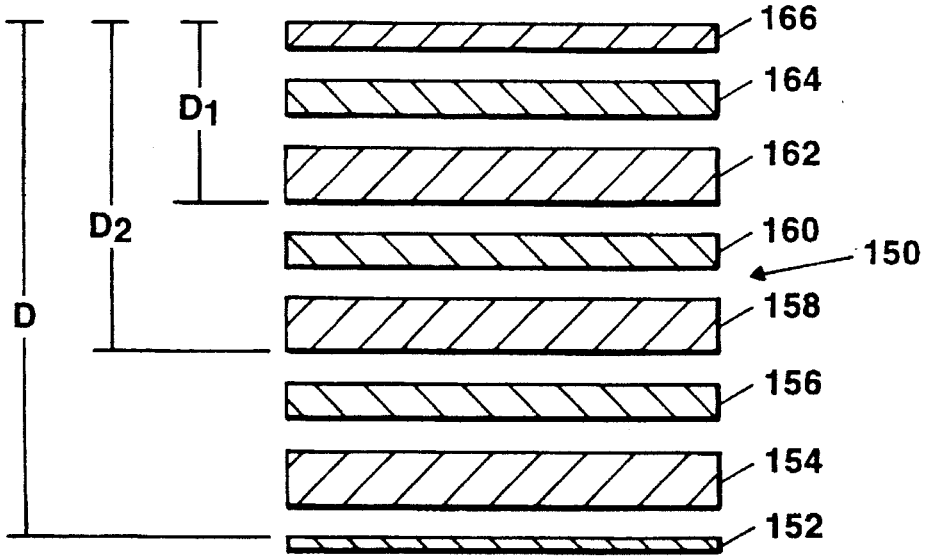
FIG. 10 is a schematic diagram illustrating a broadband electromagnetic energy absorber having three resistive sheet layers according to an embodiment of this invention.

FIG. 10 illustrates a broadband absorber according to an alternate embodiment of this invention. It is contemplated that the absorber according to this embodiment is constructed with alternating layers of dielectric material and resistive material to be described further below. It is further contemplated that the resistive material to be described can be replaced by an appropriate circuit analog conductive material to generate the desired broadband absorption characteristics. However, the description herein shall be directed primarily toward the use of a resistive material in each layer of the absorber. It is also contemplated that the absorber described, according to this embodiment, can be utilized as a structural member or, alternatively, can be applied or located over an existing structural member in the form of a "parasitic" absorber. Thus, the absorber according to this embodiment can be constructed in either rigid, semirigid or flexible form. Materials utilized to construct the absorber in such forms should be varied to obtain the desired rigidity or flexibility.

The absorber 150 of FIG. 10 includes a ground plane or surface 152 that, according to this embodiment, can comprise an expanded mesh copper screen or another conductive surface, such as the metallic structural member of an object to be covered. Positioned over the ground plane 152 is a first, lowermost dielectric layer 154. Over the first, dielectric layer 154 is located a first, lowermost, resistive layer 156 that, according to this embodiment, can comprise a broken pattern resistive sheet, of the form described hereinabove, including a plurality of geometric shapes (such as squares) joined by runners for ease of application. Over the first resistive layer 156 is positioned a second, central, dielectric layer 158 and over this dielectric layer 158 is positioned a central broken pattern resistive layer 160 that can also comprise a broken pattern resistive sheet. Over the central resistive layer 160 is positioned an uppermost dielectric layer 162 and an uppermost resistive layer, also a broken pattern resistive sheet according to this embodiment, 164. A dielectric skin layer 166 forms the outermost layer of the absorber. This layer can comprise any number of dielectric materials and can be chosen both for its dielectric properties and for its ability to protect the overall absorber from impact damage and/or attack by environmental agents.

The attachment of layers to each other can be accomplished by means of adhesive or by utilizing molding processes in combination with a liquid hardenable matrix, as described hereinabove according to the preceding embodiments. The layers should be joined with sufficient strength to obtain the desired strength and rigidity for the absorber 150, and to ensure that the layers remain joined together on exposure to the particular environment in which the absorber 150 is utilized.

According to a preferred embodiment, the dielectric layers 154, 158 and 162 can each comprise a polyethylene foam. The skin layer, according to a preferred embodiment, can be constructed from polyethylene foam or a composite material such as fiberglass or epoxy-glass.

The resistive layers 156, 160 and 164 can comprise a resistive sheet such as DuPont XC™ film which, as described above, is a polyimide film having a lossy material, namely, carbon black formulated thereinto. This material has a sheet impedance, in uncut form, of approximately 377 Ohms when provided in a thickness of 0.002 inch to 0.004 inch. This impedance closely corresponds with that of air in free space. Thus, incident electromagnetic radiation passes through this material in a manner somewhat similarly to its passage through air in free space.

It is contemplated that, by manipulating the relative impedance of each of the resistive layers 156, 160 and 164, and by spacing these layers at appropriate distances from the ground plane 152, the absorber 150 can be imbued with desirable broadband absorption characteristics. In particular, the following ratio of impedances can be used to govern a broadband absorber: the first, lowermost, resistive layer, includes an approximate impedance of 1500 Ohms or 377 Ohms/0.25. The second, central resistive layer 160 has an impedance of 540 Ohms or 377 Ohms/0.7; and the third, uppermost resistive layer has an impedance of 220 Ohms or 377 Ohms/1.7. These values are directed generally toward frequencies in the range of 1–18 GHz. However, a broader or differing range of frequencies can also be covered by varying the impedances of the layers to generate the desired absorptive "nulls".

Hence, as taken in increasing distance from the ground plane 152, the impedances of each successive resistive layers are approximately 4, 1.4 and 0.6 times the impedance of air in free space, in this embodiment. Such impedance values can be obtained by altering the composition of the resistive sheet or, alternatively, by changing the size and spacing of geometric shapes in each resistive layer as set forth above. Size and spacing of the shapes are based on a variety of variables and, hence, are generally determined by interpolation based upon the formation sheets with differing size geometric shapes and measurement of the characteristic impedance of each of the sheets until a sheet having geometric shapes that give the desired impedance are obtained. Once a desired geometric shape and size is found for a given batch and/or thickness of resistive sheet material, this shape and size can be maintained throughout the production cycle. In this embodiment the shape can comprise squares with runners therebetween. The sizes are chosen based upon the procedure discussed above. As detailed in FIG. 10, the overall distance from the outer surface of the skin layer 166 to the upper surface of the ground plane 152 is D. This value is chosen depending upon the range of frequencies in which absorption is desired. D can, typically, be between 0.3 and 1.0 inch. The distance from the outer surface of the skin layer 166 to the bottom surface of the third dielectric layer 162 is denoted as $D_1$. $D_1$ typically equals approximately ⅓ of D. The distance from the outer surface of the skin layer 166 to the bottom surface of the second dielectric layer 158 is denoted as $D_2$. $D_2$ is approximately ⅔ of D.

Figure 11:
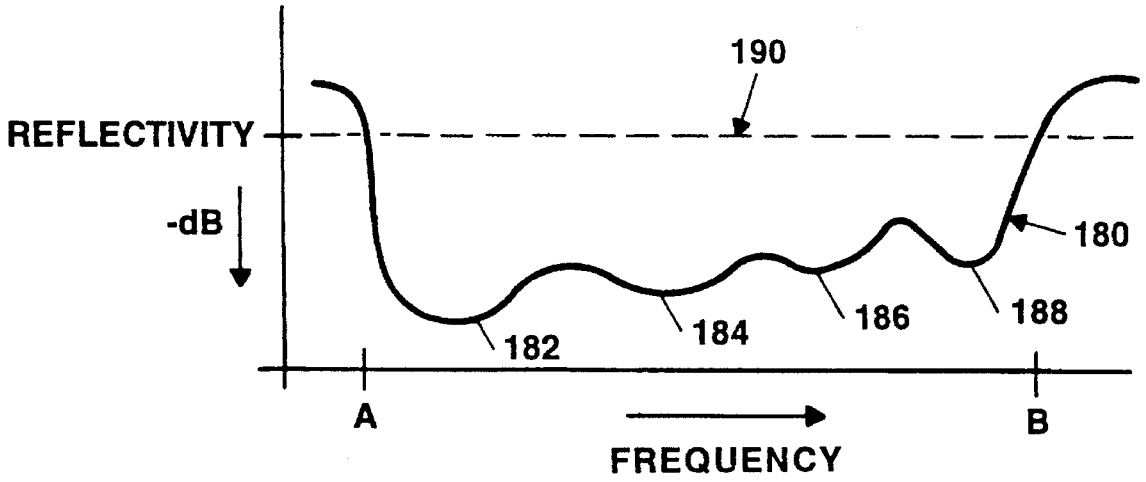
FIG. 11 is a graph illustrating, generally, a characteristic absorption curve for a broadband absorber according to FIG. 10.

The skin layer 166, according to a preferred embodiment, can have a thickness of approximately 0.062 inch. The thickness of each of the resistive layers 156, 160 and 164 is typically 0.002 inch to 0.004 inch according to this embodiment and, as noted above, can comprise a polyimide film having a lossy substance such as carbon black therein. The film thickness, thus, comprises a small percentage of the overall thickness D of the layered structure. Given such a spacing of layers, in combination with the impedance values described hereinabove, a broadband absorber having absorptive characteristics generally described in FIG. 11 is generated. The absorption curve 180 comprises a series of absorptive "nulls" 182, 184, 186 and 188 that span discrete frequency ranges virtually to the point of overlap. Hence, the entire range of absorption over a given frequency band A–B, remains below the desired point of electromagnetic reflectivity 190.

The foregoing has been a detailed description of preferred embodiments. Various modifications and equivalents are contemplated herein. The foregoing description, therefore, is meant to be taken only by way of example and not to otherwise limit the scope of this invention. For example, various other materials can be utilized in the formation of circuit analog and resistive layers according to this invention. Similarly, various adhesives and dielectric materials can be substituted for those disclosed herein. Finally, while each of the preferred embodiments depict two or three impedance layers, it is contemplated that fewer or more layers can be included depending upon the number of absorptive nulls desired. Therefore, the scope of this invention should only be deemed to be limited by the appended claims.

What is claimed is:

1. A broadband electromagnetic energy absorber comprising:

a conductive ground surface;

a first dielectric layer positioned over the ground surface;

a first resistive layer defining a first predetermined broken pattern thereon positioned over the first dielectric layer;

a second dielectric layer positioned over the first resistive layer;

a second resistive layer defining a second predetermined broken pattern thereon positioned over the second dielectric layer;

a third dielectric layer positioned over the second resistive layer;

a third resistive layer defining a third predetermined broken pattern thereon positioned over the third resistive layer; and a dielectric skin layer, comprising an outermost layer, positioned over the third resistive layer, wherein each of the first resistive layer, the second resistive layer and the third resistive layer are spaced from the ground surface so that the absorber absorbs electromagnetic energy over a broad frequency range.

2. A broadband electromagnetic energy absorber as set forth in claim 1 wherein a spacing from an outer surface of the skin layer to a lower surface of the first dielectric layer comprises D and wherein a spacing from the outer surface to the second resistive layer comprises approximately ⅓ D and a spacing from the outer surface to the first resistive layer comprises approximately ⅔ D.

3. A broadband electromagnetic energy absorber as set forth in claim 1 wherein at least one of the first dielectric layer, the second dielectric layer and the third dielectric layer comprises polyethylene foam.

4. A broadband electromagnetic energy absorber as set forth in claim 1 wherein at least one of the first resistive layer, the second resistive layer and the third resistive layer comprises a resistive sheet having a lossy material therein.

5. A broadband electromagnetic energy absorber as set forth in claim 4 wherein the resistive sheet comprises a polyimide sheet and the lossy material comprises carbon black.

6. A broadband electromagnetic energy absorber as set forth in claim 4 where at least one of the first resistive layer, the second resistive layer and the third resistive layer includes a broken pattern defining a plurality of geometric shapes thereon.

7. A broadband electromagnetic energy absorber as set forth in claim 6 wherein the geometric shapes comprise squares.

8. A broadband electromagnetic energy absorber as set forth in claim 7 wherein the squares include narrow runners formed therebetween so that the squares are maintained in a predetermined position in spacing relative to each other.

9. A broadband electromagnetic energy absorber as set forth in claim 6 wherein the geometric shapes include narrow runners therebetween so that the geometric shapes are maintained at a predetermined spacing and position relative to each other.

10. A broadband electromagnetic energy absorber as set forth in claim 6 wherein at least two of the first resistive layer, the second resistive layer and the third resistive layer define a plurality of geometric shapes thereon and wherein a size of the geometric shapes in one of the first resistive layer, the second resistive layer and the third resistive layer is different than a size of the geometric shapes in another of the first resistive layer, the second resistive layer and the third resistive layer so that an impedance of the one of the first resistive layer, the second resistive layer and the third resistive layer differs from an impedance of the other of the second and first resistive layer, the second resistive layer and the third resistive layer.

11. A broadband electromagnetic energy absorber as set forth in claim 10 wherein each of the first resistive layer, the second resistive layer, and the third resistive layer define a broken pattern comprising a plurality of regular geometric shapes therein and wherein the geometric shapes on each of the first resistive layer, the second resistive layer and the third resistive layer are each sized so that each of the first resistive layer, the second resistive layer and the third resistive layer have a predetermined discrete impedance.

12. A broadband electromagnetic energy absorber as set forth in claim 11 wherein the first resistive layer has an impedance approximately 4 times an impedance of air and free space, the second resistive layer has an impedance approximately 1.4 times the impedance of air and free space and the third resistive layer has an impedance approximately 0.6 times an impedance of air and free space.

13. A broadband electromagnetic energy absorber as set forth in claim 12, wherein a spacing from an outer surface of the skin layer to a lower surface of the first dielectric layer, adjacent the conductive ground surface, equals a distance D and wherein a spacing from the outer surface to the second resistive layer comprises approximately ⅓ D and a spacing from the outer surface to the first resistive layer comprises approximately ⅔ D.

14. A broadband electromagnetic energy absorber as set forth in claim 1 wherein each of the first dielectric layer, the first resistive layer, the second dielectric layer, the second resistive layer, the third dielectric layer, the third resistive layer and the dielectric skin layer are constructed and arranged to define an absorber that comprises a structural member of an object.

15. A broadband electromagnetic energy absorber as set forth in claim 14 wherein the conductive ground surface comprises a metallic structural base of the object.

16. A broadband electromagnetic energy absorber as set forth in claim 14 wherein each of the first dielectric layer, the first resistive layer, the second dielectric layer, the second resistive layer, the third dielectric layer, the third resistive layer and the dielectric skin layer are joined by a hardened liquid matrix.

17. A broadband electromagnetic energy absorber as set forth in claim 1 wherein each of the first dielectric layer, the first resistive layer, the second dielectric layer, the second resistive layer, the third dielectric layer, the third resistive layer and the dielectric skin layer are joined by a hardened liquid matrix.

18. A broadband electromagnetic energy absorber as set forth in claim 1 wherein the conductive ground surface comprises an electrically-conductive metallic screen.

19. A method for forming broadband electromagnetic energy absorber comprising the steps of:

providing a conductive ground surface;

providing a first dielectric layer over the ground surface;

providing a first resistive layer defining a predetermined broken pattern thereon over the first dielectric layer;

providing a second dielectric layer over the first resistive layer;

providing a second resistive layer defining a second predetermined broken pattern thereon over the second dielectric layer;

providing a third dielectric layer over the second resistive layer;

providing a third resistive layer defining a third predetermined broken pattern thereon over the third resistive layer; and providing a dielectric skin layer, comprising an outermost layer, over the third resistive layer wherein each of the first resistive layer, the second resistive layer and the third resistive layer are spaced from the ground surface so that incident electromagnetic energy is absorbed over a broad frequency range.

20. A method as set forth in claim 19 wherein the steps of providing the first resistive layer, providing the second resistive layer, and providing the third resistive layer comprise forming the first predetermined broken pattern having a plurality of geometric shapes that generate a first impedance, forming the second predetermined broken pattern having a plurality of geometric shapes that generate a second predetermined impedance and forming the third predetermined broken pattern having a plurality of geometric shapes that generate a third impedance.

21. A method as set forth in claim 20 wherein each of the first predetermined impedance, the second predetermined impedance and the third predetermined impedance have different values.

22. A method as set forth in claim 21 wherein the first predetermined impedance is approximately 4 times an impedance of air and free space, the second predetermined impedance is approximately 1.4 time the impedance of air and free space and the third predetermined impedance is approximately 0.6 times the impedance of air in free space.

23. A method as set forth in claim 22 wherein the step of providing the first resistive layer, providing the second resistive layer and providing the third resistive layer include defining a distance D that comprises a spacing from an outer surface of the skin layer to a lower surface of the first dielectric layer, adjacent the conductive ground surface, and spacing the second resistive layer from the outer surface at approximately ⅓ D and spacing the first resistive layer from the outer surface a distance of approximately ⅔ D.

24. A method as set forth in claim 19 wherein the step of providing the first resistive layer, providing the second resistive layer and providing the third resistive layer include defining a distance D that comprises a spacing from an outer surface of the skin layer to a lower surface of the first dielectric layer, adjacent the conductive ground surface, and spacing the second resistive layer from the outer surface at approximately ⅓ D and spacing the first resistive layer from the outer surface a distance of approximately ⅔ D.

25. A method as set forth in claim 1 wherein the steps of providing the first dielectric layer, providing the second dielectric layer and providing the third dielectric layer comprise constructing at least one of the first dielectric layer, the second dielectric layer and the third dielectric layer of polyethylene foam.

26. A method as set forth in claim 19 further comprising joining each of the first dielectric layer, the first resistive layer, the second dielectric layer, the second resistive layer, the third dielectric layer, the third resistive layer and the dielectric skin layer together in a mold using a hardened liquid matrix.

27. A method as set forth in claim 26 wherein the step of providing a conductive ground surface includes providing a ground surface comprising a metallic screen.

28. A method as set forth in claim 19 wherein the step of providing a conductive ground surface includes providing a ground surface that comprises a structural base member of an object.

29. A method as set forth in claim 19 further comprising defining a first impedance on the first resistive layer, a second impedance on the second resistive layer and a third impedance on the third resistive layer and spacing each of the first resistive layer, the second resistive layer and the third resistive layer relative to the conductive ground surface, thereby forming a layered structure that absorbs electromagnetic energy over a broad frequency range.

30. A method as set forth in claim 29 wherein the step of defining the first impedance, defining the second impedance, and defining the third impedance include forming geometric shapes on a resistive sheet having a size and shape that generates a predetermined impedance.

31. A method as set forth in claim 30 wherein the step of forming includes providing narrow runners between each of the geometric shapes so that each of the geometric shapes is maintained in a relative stationary position with respect to other of the geometric shapes.

* * * * *